US005572621A

United States Patent [19]

Martin

[11] Patent Number: 5,572,621

[45] Date of Patent: Nov. 5, 1996

[54] SPEECH SIGNAL PROCESSING DEVICE WITH CONTINUOUS MONITORING OF SIGNAL-TO-NOISE RATIO

[75] Inventor: Rainer Martin, Aachen, Germany

[73] Assignee: U.S. Philips Corporation, New York, N.Y.

[21] Appl. No.: 308,768

[22] Filed: Sep. 19, 1994

[30] Foreign Application Priority Data

Sep. 21, 1993 [EP] European Pat. Off. ..... 93115202

[51] Int. Cl.[6] ..... G10L 3/02

[52] U.S. Cl. ..... 395/2.36

[58] Field of Search ..... 333/109, 111; 381/155; 395/2.35–2.37

[56] References Cited

U.S. PATENT DOCUMENTS 5,208,864 5/1993 Kaneda ..... 381/46

OTHER PUBLICATIONS

D. M. Etter et al, "Adaptive Estimation of Time Delays in Sampled Data Systems", IEE Transactions, vol. ASSP 29, No. 3, Jun. 1981, pp. 582–587.

Boudreau et al., "Joint Time–Delay Estimation and Adaptive Recusive Least Squares Filtering, IEEE Transactions on Signal Processing", vol. 4, No. 2, Feb. 1993.

Ho et al., "Adaptive Time Delay Estimation In Noisy Environments", IEEE 1991.

Ho et al., "Adative Time Delay Estimation In Nonstationary Signal And/Or Noise Power Environments", IEEE Transaction on Signal Processing, vol. 4, No. 7, Jul. 1993.

*Primary Examiner*—Allen R. MacDonald
*Assistant Examiner*—John Michael Grover
*Attorney, Agent, or Firm*—Leroy Eason

[57] ABSTRACT

A mobile radio set includes a speech processing device for processing digital samples (x(i)) of speech signals which have noise components as well as speech components. Such device includes a control unit for continuously forming estimates of the signal-to-noise ratio of the speech signals by determining and smoothing the power values of the samples thereof, and determining the minimum of each successive group of L smoothed power values. The groups uninterruptedly succeed each other and each contains a sufficient number of smoothed power values so that all the values of a single group associated with a random phoneme of the speech signal can be combined. An estimate of the present signal-to-noise ratio is formed based on the present smoothed power value and the most recently determined minimum successive smoothed power value.

6 Claims, 5 Drawing Sheets

SPEECH SIGNAL PROCESSING DEVICE WITH CONTINUOUS MONITORING OF SIGNAL-TO-NOISE RATIO

BACKGROUND OF THE INVENTION

1. Field of the Invention

The invention relates to a mobile radio set comprising a speech processing device for processing speech signals formed by noise components and speech components.

2. Description of the Related Art

In the field of speech processing, speech signals to be processed often contain noise components, which leads to a degradation of the speech quality and thus especially to degraded intelligibility. This problem occurs especially in mobile radio sets which are used in private cars that have a hands-free facility. Speech signals received from microphones of the hands-free facility in the private car contain, on the one hand, speech components generated by the user (speech source) of the mobile radio set inside the private car and, on the other, noise components which are the result of further ambient noise of the mobile radio set. During a ride the ambient noise consists, in essence, of engine and driving noises.

From "Proceedings of the IEEE, Vol. 75, No. 2, February 1987" is known a device comprising a plurality of microphones in which, except for one microphone signal, all further microphone signals are applied to adjustable delay elements. The microphone signal shifted with time relative to each other by the delay elements, are added together and subjected to further processing. The useful signal components of the microphone signals originate, in essence, from a single acoustic source which is at different distances from the microphones.

Thus, for an acoustic signal generated by the acoustic source there are different delays to the spatially arranged microphones. The acoustic signal is the source of time-shifted but otherwise substantially identical useful signal components of the microphone signals. The useful signal components are thus strongly correlated. Noise components of the microphone signals, however, are at most slightly correlated when the microphones are suitably arranged. A suitable setting of the delay elements with respect to the position of the acoustic source thereby improves the output signal of the device as to its signal-to-noise ratio.

Such a device provides satisfactory results only if the signal-to-noise ratio of the microphone signals to be processed lies above a threshold; i.e. the useful signal components are large enough compared with the noise components. Especially; the noise components must not be greater than the useful signal components. For this reason an estimate must be made of the signal-to-noise ratio of at least one microphone signal each time the delay elements are reset, so that erroneous functioning of the speech processing device is avoided when the signal-to-noise ratio is insufficient.

Devices used to date for determining the signal-to-noise ratio of a speech signal formed by noise components and speech components determine a value for the noise power during a speech pause when only noise components occur. The detection of a speech pause is based, for example, upon a statistical evaluation of the speech signal by histograms or upon evaluation of the short-term power of the noisy speech signal.

Such a speech-pause dependent determination of the signal-to-noise ratio is, on the one hand, susceptible to error because the speech pause needs to be detected and, on the other hand, slow because the signal-to-noise ratio can only be updated when there is a speech pause, whereas in between the speech pauses the power of the noise component may have changed.

SUMMARY OF THE INVENTION

Therefore, it is an object of the invention to provide a mobile radio set comprising a speech processing device of the type defined in the opening paragraph, in which estimation of the signal-to-noise ratio of the speech signals is improved.

That object is achieved in that the speech processing device for processing speech signals which consist of noise components and speech components includes means for continuously forming estimates of the signal-to-noise ratio of the speech signals. Such estimation comprises

- means for determining the power values of samples of the speech signals,
- means for smoothing the power values,
- means for determining each time the minimum of a group of L successive smoothed power values, the groups uninterruptedly succeeding each other and containing enough smoothed power values so that all the smoothed power values of a single group associated with a random phoneme of the speech signal can be combined, and
- means for forming an estimate of the present signal-to-noise ratio from the present smoothed power value and the most recently determined minimum power value.

The behaviour of the smoothed power values of speech samples having noise and speech components shows peaks in between successive speech pauses (for example, the pause between two words), i.e. regions of brief high power alternated by regions of rather low power. The smoothed power values between the peaks are used for estimating the noise power. A phoneme of a speech signal is assigned at least one peak of the characteristic line of the smoothed power values. A phoneme is the smallest meaningful unit of speech and is a sound formed, on the one hand, by a vowel or, on the other hand, by a single consonant or various consonants. If the groups having L successive smoothed power values are each large enough so that a random phoneme and thus also a random peak in the characteristic line of the smoothed power values can be completely detected, it is ensured that at least one value of a lower-power region lying beside a peak of each group can be detected. In this manner it is avoided that a group contains only smoothed power values belonging to a peak. The minimum of a group can thus be used for estimating the noise power. A scaling factor is used to improve the estimation. The groups may be adjacent to each other or overlapping. For the case where the groups are adjacent to each other, the minimum distance between two successive updatings of the weighted minimum used for estimating the noise power is L sampling intervals of the speech signal. If the groups are overlapping, so that at least one smoothed power value belongs to more than one group, the minimum time interval between two updatings of the weighted minimum may be reduced. Due to the continuous formation of estimates of the signal-to-noise ratio, which formation is independent of speech pauses, the speech processing device may also adapt itself to changes of the noise power in between two speech pauses. A speech pause is not necessary for updating the estimate of the noise power.

An embodiment of the invention comprises means for forming adjacent sub-groups of M=L/W successive smoothed power values each, where W is a natural integer and W sub-groups form one group, and for determining the minimum of the minima of W successive sub-groups to determine the minimum of the associated group.

With little expenditure, both adjacent and overlapping groups can be realised in this manner. In adjacent groups a new estimate for the noise power is determined after every L sampling intervals, from the minimum of the minima of every W successive sub-groups. In overlapping groups a new estimate for the noise power is formed by the minimum of the minima of W successive sub-groups after M sampling intervals.

In that embodiment it is further possible to provide means for utilizing the most recently determined minimum of a sub-group instead of the most recently determined minimum of a group when there is a predeterminable number of monotonously rising minima of sub-groups, to estimate the present value of the signal-to-noise ratio.

In this manner an estimate of the noise power is updated after every M sampling intervals, whereas only M previous smoothed power values are used for the estimation. Better estimates of the signal-to-noise ratio of the speech signals are obtained with these updatings of the noise power estimates, which updatings are faster and better adapted to the variation of the smoothed power values.

A further embodiment of the invention may be arranged such that means are provided for utilizing the present smoothed power value instead of a group or sub-group minimum that has been determined most recently, to estimate a present value of the signal-to-noise ratio for the case where the present smoothed power value is smaller than the minimum that has been determined most recently.

Irrespective of the size and arrangement of groups or sub-groups, the most recently determined minimum for low smoothed power values is substituted forthwith by the present smoothed power value. In that case an estimate of the noise power is updated undelayed by the most recently determined smoothed power value.

Another embodiment of the invention comprises speech processing means for processing the speech signals in dependence on estimates of the signal-to-noise ratio.

The speech processing means are prevented from working erroneously in the event of an insufficient signal-to-noise ratio of the speech signals to be processed, and especially from supplying output signals whose speech quality is very low. For example, if the signal-to-noise ratio is too low, previously determined settings of the speech processing means, i.e. when there was a sufficiently high signal-to-noise ratio, can be kept constant until again a sufficiently high signal-to-noise ratio occurs.

BRIEF DESCRIPTION OF THE DRAWINGS

Exemplary embodiments of the invention will be further explained in the following with reference to drawings, in which.

DESCRIPTION OF THE PREFERRED EMBODIMENTS

Figure 1:
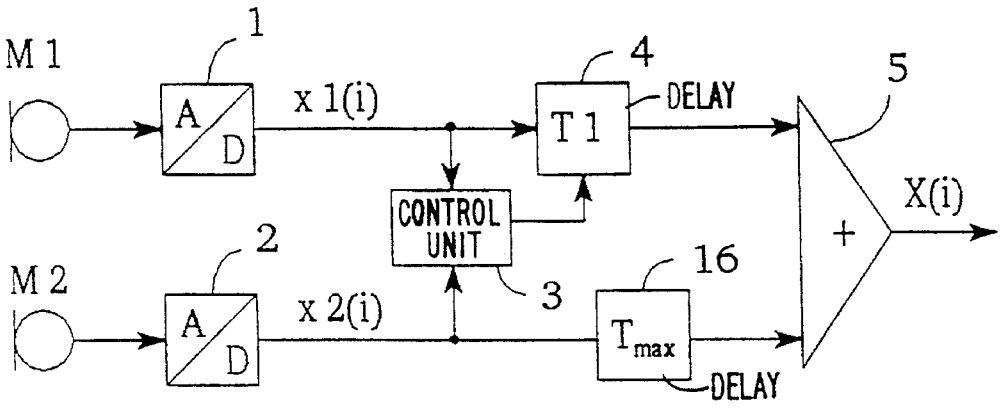
FIG. 1 shows a speech processing device for two speech signals.

The speech processing device shown in FIG. 1 comprises two microphones M1 and M2. They are used for changing acoustic speech signals into electrical speech signals which are formed by speech and noise components. The speech components come from a single speech source (speaker) which, as a rule, has different distances to the two microphones M 1 and M2. The speech components are thus highly correlated. The noise components of the two speech signals received from the microphones M1 and M2 are not ambient noise produced by the single speech source, and may be assumed to be uncorrelated or only slightly correlated with suitable microphone distances from 10 to 60 cm if the microphones are situated in a so-called reverberating environment like, for example, inside the car or in an office. If the speech source and speech processing device are located, for example, in a private car the noise components are especially caused by engine or driving noise.

The microphone signals generated by the microphones M1 and M2 are digitized by the digitizers 1 and 2. The digitized microphone signals, which are thus available as sampling values x1(i)and x2(i) are evaluated by a control unit 3 which is used for controlling the setting of a delay element 4. The sampled microphone signals x1(i) and x2(i) will in the following be referenced microphone or speech signals. The delay element 4 delays the microphone signal x1 by a delay value T1 which can be set by the control device 3. An adder 5 adds the microphone signal x1(i), delayed by the delay element 4, to the microphone signal x2(i) delayed by a constant time delay $T_{max}$ caused by a delay element 16. The delay element 16 is provided to stop both a precursing and a postcursing effect of the microphone signal x1(i) relative to the microphone signal x2(i). A sum signal X1(i) available on the output of the adder 5 is a sampled speech signal with a higher signal-to-noise ratio than the signal-to-noise ratios of the speech signals x1(i) and x2(i). A suitable setting of the delay time T1 of the delay element 4 will cause, during the addition in the adder 5, a gain of the power of the speech components of the two speech signals x1(i) and x2(i) by about a factor of 4, and a gain of the power of the noise components by about a factor of 2. This yields an improvement of the power-related signal-to-noise ratio of about 3 dB.

Figure 2:
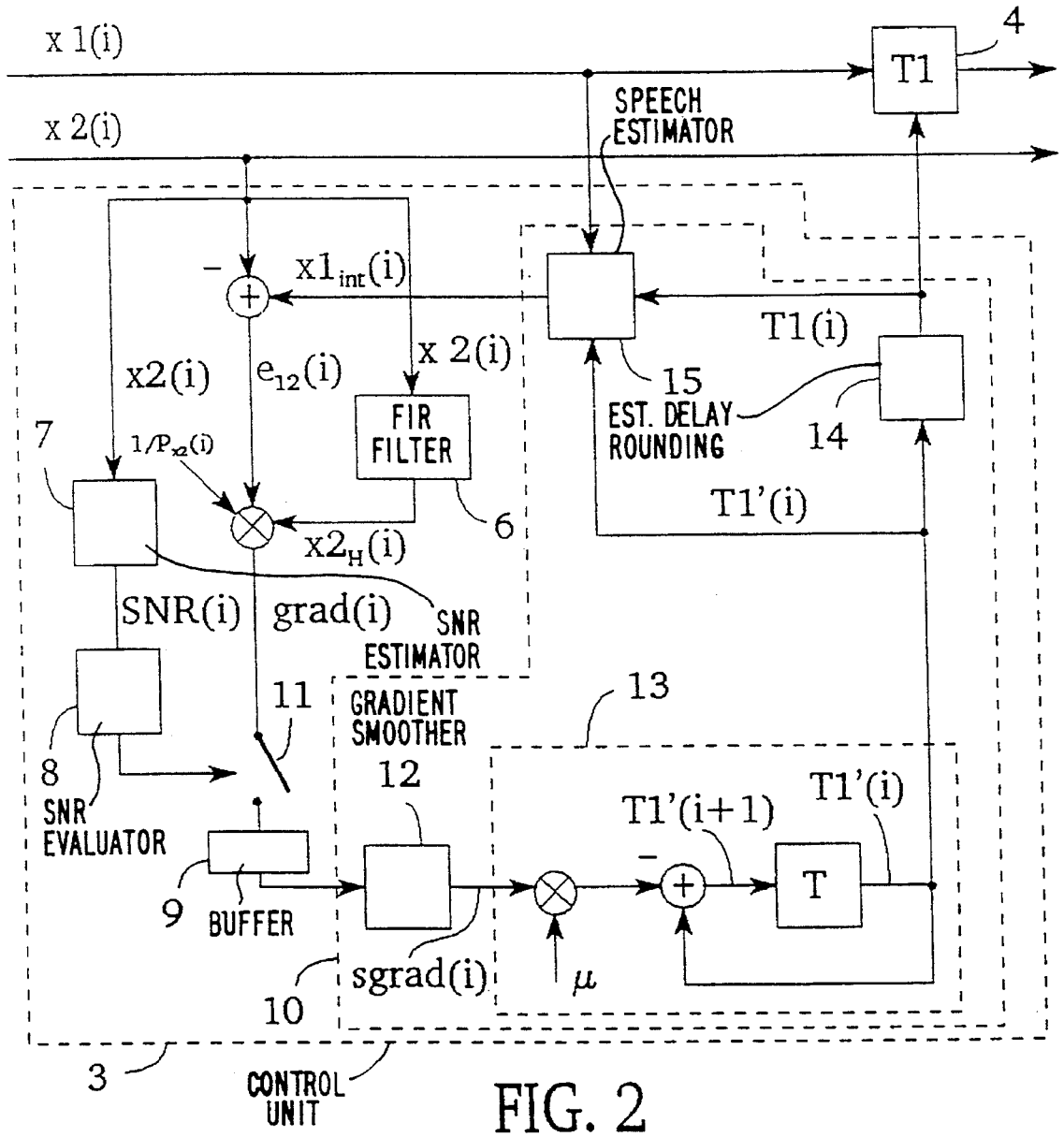
FIG. 2 shows a control unit for setting the time shift between the two speech signals shown in FIG. 1.

FIG. 2 gives a further explanation of the operation of the control unit 3 with the aid of a block circuit diagram. Error values $e_{12}(i)$ are obtained from a subtraction according to $$e_{12}(i)=x1_{int}(i)-x2(i) \quad (1)$$

of the speech signal x2(i) and speech signal estimates $x1_{int}(i)$. The speech signal estimates $x1_{int}(i)$ are values which are the result of an interpolation of sample values of the speech signal x1(i). The computation of the speech signal estimates $x1_{int}(i)$ will be explained hereinafter, i is a variable which may assume integral values and by which may be indicated, on the one hand, sampling instants of the speech signals x1(i) and x2(i) and, on the other, program cycles of the control unit 3 which is programmable and comprises control means, a new sample value for each speech signal being processed in a single program cycle.

A digital filter 6 performs a Hilbert transform of the sample values x2(i):

$$x2_H(i) = \sum_{k=0}^{K} h(k)*x2(i-k) \quad (2)$$

The digital filter 6 which produces the values $x2_H(i)$ from x2(i) is a $K^{th}$-order FIR filter which has coefficients h(0), h(1), . . . , h(K). In the present exemplary embodiment K is equal to sixteen, so that the digital filter 6 has seventeen coefficients. The digital filter 6 has the value-dependent transfer function of a low-pass filter. It further produces a phase shift of 90°. The fixed 90° phase shift is the decisive property of the digital falter 6; the variation of the value of the transfer function is not decisive for the operation of the speech processing device. The digital filter 6 may also be formed by a differentiator, but this would certainly lead to a suppression of low-frequency components of x2(i) and thus to reduced power of the speech processing device.

The output values $x2_H(i)$ are multiplied by the error values $e_{12}(i)$ and the reciprocal value $1/P_{x2}(i)$ of a short-term power $P_{x2}(i)$, while the short-term power $P_{x2}(i)$ is formed in accordance with $$P_{x2}(i)=P_{x2}(i-1)+[x2(i)]^2-[x2(i-N)]^2 \quad (3)$$

N denotes the number of sample values of x1 used for the computation. N is, for example, equal to 65. The multiplication by $1/P_{x2}(i)$ is used to avoid instabilities in the control device 3 when the delay element 4 is controlled. As a result of $$grad(i) = \frac{1}{P_{x2}(i)} *e(i)*x2_H(i) \quad (4)$$

an estimated gradient grad(i) of the squares or of the power of the error values $e_{12}(i)$ thus occurs in the program cycle i, which gradient is normalized to the short-term power $P_{x2}(i)$.

A function block 7 continuously forms from the sample values of the speech signal x2(i) estimates SNR(i) of the associated signal-to-noise ratio which are evaluated by a function block 8. Also an evaluation of the speech signal x1(i) in lieu of the speech signal x2(i) is possible, without the operational capacities of the speech processing device being constrained. The operation of the function block 7 will be further explained in the following with reference to FIGS. 6 to 8. The function block 8 carries out a threshold decision with respect to the estimates SNR(i). Not until the estimates SNR(i) lie above a predeterminable threshold will a buffer 9 be overwritten with the newly determined gradient estimate grad(i). This operation is symbolized by the closed state of a switch 11 which switch is controlled by the function block 8. The contents (grad(i)) of the buffer 9 are further processed by a function unit 10. For the case where an estimate SNR(i) lies below the predeterminable threshold value, the buffer 9 is not overwritten with the newly determined gradient estimate grad(i) and retains its previous contents, which is symbolized by the open state of the switch 11. The predeterminable threshold, on which the opening and closing of the switch 11 by the function block 8 depends, preferably lies between 0 and 10 dB.

Buffer 9 supplies the gradient estimates grad(i) stored therein to the function unit 10 which is also supplied with sample values of the speech signal x1(i) and which is used both for supplying speech signal estimates $x1_{int}(i)$ and for setting the delay element 4.

The gradient estimates grad(i) are further processed to smoothed gradient estimates sgrad(i) by a function block 12 in accordance with $$sgrad(i)=\alpha*sgrad(i-1)+(1-\alpha*grad(i)) \quad (5)$$

α is a constant which in the exemplary embodiment has the value of 0.95. The values sgrad(i) are used by a function block 13 to adapt delay estimates T1'(i) in accordance with $$T1'(i+1)=T1'(i)-\mu*sgrad(i) \quad (6)$$

The delay estimates T1'(i) are thus determined recursively. μis a constant factor i.e. convergence parameter and lies in the range of $$0<\mu<\frac{1}{10*R_{x2x2}(0)} \quad (7)$$

$R_{x2x2}$ denotes an autocorrelation function of the speech signal x2(i) at the zero position. A highly advantageous value range of μ in the present exemplary embodiment is $1.5<\mu<3$.

The delay estimates T1'(i) may also be non-integral values i.e. non-integral multiples of a sampling interval. A function block 14 rounds the delay estimates T1'(i) to integral delay values T1(i) with which the delay element 4 is set. The rounding operation by function block 14 is necessary, because values of the speech signal x1(i) to be delayed by the delay element 4 only occur at the corresponding sampling instants.

The function unit 10 further includes a function block 15 which forms the speech signal estimates $x1_{int}(i)$ according to $$x1_{int}(i)=x1(i+T1(i)+0.5*[T1'(i)-T1(i)]*[x1(i+T1(i)+1)-x1(i+T1(i)-1)] \quad (8)$$

by interpolating three adjacent sampling values x1(i+T1(i)−1), x1(i+T1(i))and x1(i+T1(i)+1) of the speech signal x1. The function block 15 is thus capable, by the speech signal estimate $x1_{int}(i)$ in the program cycle i, of forming or interpolating respectively, a value of the speech signal X1 at the instant i+T1(i), i.e. at an instant between two sampling instants. The described interpolation by function block 15 can be substituted by the function block 15 carrying out a low-pass filtering of the sample values x1(i) to interpolate values between the sampling instants.

If the delayed sample values of the speech signal x1(i) available on the output of the delay element 4 were used in lieu of the speech signal estimates $x1_{int}(i)$ to determine the error values $e_{12}(i)$, as this is known from "IEEE Transactions on Acoustics, Speech, and Signal Processing, Vol. ASSP-29, No. 3, June 1981, pp. 582–587", the delay values T1(i) with which delay element 4 is set would no longer converge if error values $e_{12}(i)=0$ were reached. There would be strong fluctuation of the rounded delay values T1(i). They would fluctuate between two delay values with the spacing of a sampling interval. The corresponding real time-delay between the speech components, which delay is determined by the different paths from the speaker to the microphones M1 and M2, would then lie between these two delay values. In the present exemplary embodiment such fluctuations are avoided in that speech signal estimates $x1_{int}(i)$ are used when the error values are formed, as a result of which estimates of the speech signal x1(i) are also available for delays by non-integral multiples of a sampling interval, thus also at instants which are unequal to the sampling instants i of the speech signal x1(i).

An improved way of determining the delay estimates T1'(i) is obtained with the function block 12 used for smoothing the gradient estimates grad(i).

The control device 3 adapts the delay estimates T1'(i), T1(i) respectively, so that from one program cycle to the next the square or the power of the error values $e_{12}(i)$ respectively, is reduced. The convergence of T1'(i), T1(i) respectively, is thus ensured.

Figure 3:
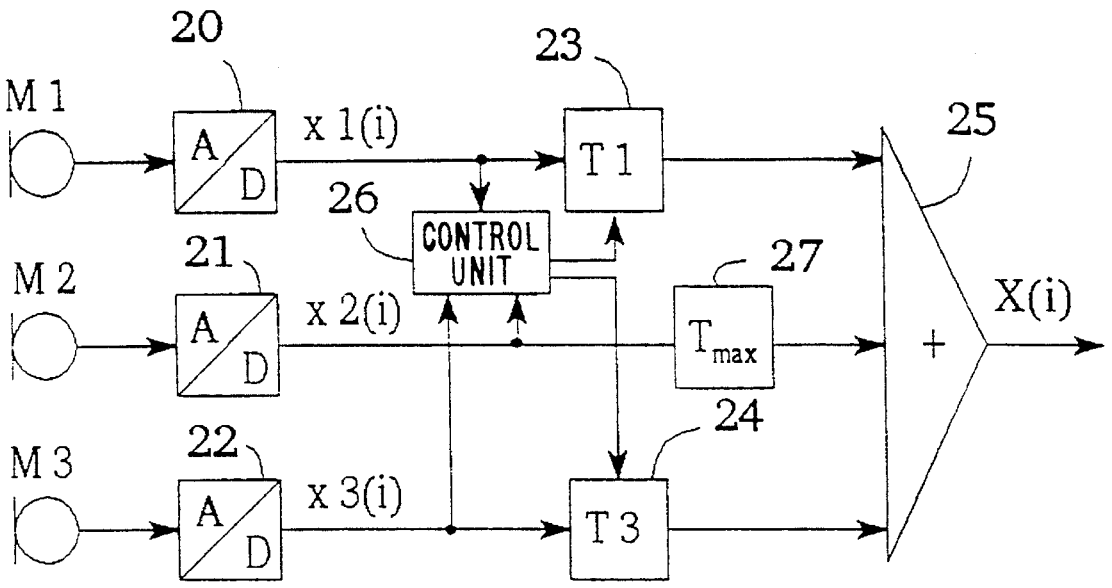
FIG. 3 shows a speech processing device for three speech signals.

FIG. 3 shows a speech processing device operating according to the principle of the speech processing device shown in FIG. 1, comprising three microphones now M1, M2 and M3 for producing microphone and speech signals. The microphone signals are applied to digitizers 20, 21 and 22, which produce digitized and thus sampled speech signals x1(i), x2(i) and x3(i) which consist of speech components and noise components. The speech signals x1(i) and x3(i) are applied to adjustable delay elements 23 and 24. In analogy with FIG. 1 the speech signal x2(i) is applied to a delay element 27 which has a fixed delay time $T_{max}$. The output values of the delay elements 23, 24 and 27 are added together by an adder 25 to form the sum signal X(i). A control device 26 evaluates the sample values of the speech signals x1(i), x2(i) and x3(i) and derives from these sample values, in analogy with the operation of the control device 3 of FIGS. 1 and 2, rounded integral delay values T1(i) and T3(i) which correspond to integral multiples of a sampling interval of the sampled speech signals x1(i), x2(i) and x3(i) and with which the delay elements 23 and 24 are set, so that an extension from two to three microphone or speech signals to be processed is made possible.

Figure 4:
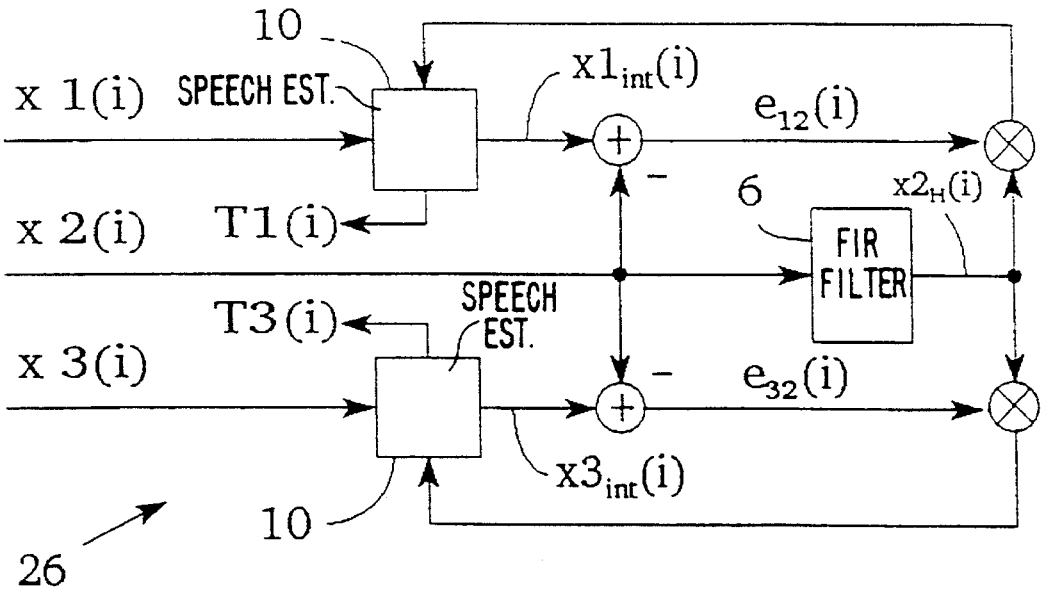
FIGS. 4 and 5 show block circuit diagrams which include control units for setting time shifts between the three speech signals shown in FIG. 3, FIGS. 6 and 7 show a block circuit diagram and a flow chart for determining the signal-to-noise ratio of a speech signal.

FIG. 4 shows a first embodiment of the control unit 26 shown in FIG. 3. Two function units 10 are provided whose structure is the same as that of the function unit 10 of FIG. 2 and which are used for setting the delay elements 23 and 24 with the rounded time delay values T1(i) and T3(i).

The top function unit 10 produces speech signal estimates x1int(i). The bottom function unit 10 produces speech signal estimates $x3_{int}(i)$. Error values $e_{12}(i)$ and $e_{32}(i)$ are the result of the subtraction $x1_{int}(i)-x2(i)$ and the subtraction $x3_{int}(i)-x2(i)$.

Here too a digital filter 6 is incorporated, which has already been described with respect to the embodiments shown in FIG. 2 and which is used for receiving the sample values x2(i) and for producing values $x2_H(i)$ which are generated by means of a Hilbert transform of the sample values x2(i). The values $x2_H(i)$ are multiplied, on the one hand, by the error values $e_{12}(i)$ and, on the other, by the error values $e_{32}(i)$. The first product $x2_H(i)*e_{12}(i)$ is applied to the top function unit 10 and the second product $x2_H(i)*e_{32}(i)$ is applied to the bottom function unit 10. The arrangement of the function blocks 7 and 8, of the buffer 9 and of the switch 11 is represented in analogy with that of FIG. 2 and is not further shown in FIG. 4 for clarity.

Figure 5:
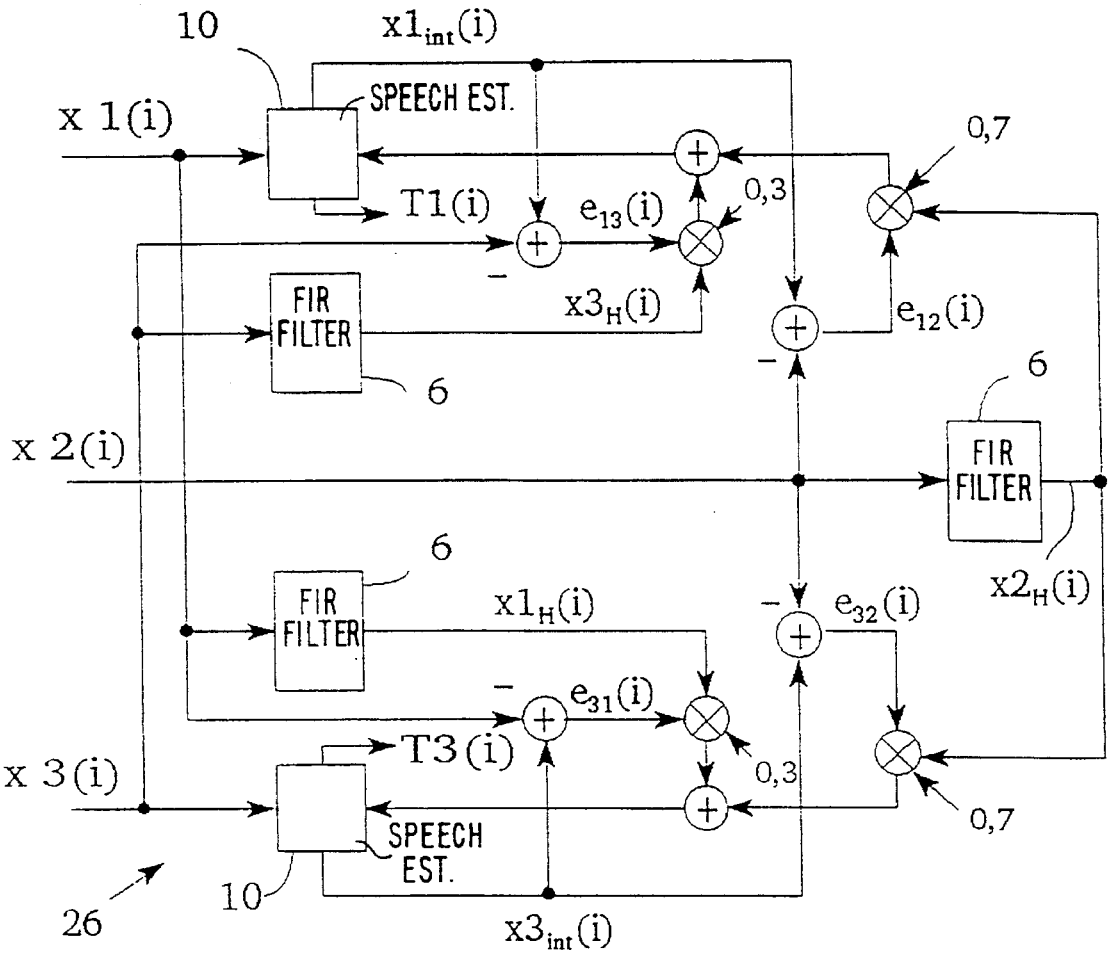

FIG. 5 shows an extended version of FIG. 4 of the control device 26. Contrary to FIG. 4, three digital filters 6 in lieu of only one digital filter 6 are included. They form the values $x1_H(i)$, $x2_H(i)$ and $x3_H(i)$ from the respective speech signal samples x1(i), x2(i) and x3(i) by means of a Hilbert transform.

In the top half of the block diagram shown in FIG. 5, error values $e_{13}(i)$ are formed from the subtraction $x1_{int}(i)-x2(i)$, which form part of a first product $0.3*e_{13}(i)*x3_H(i)$. A second product is obtained from $0.7*e_{12}(i)*x2_H(i)$. The two products correspond to weighted gradient estimates of the squares of error values $e_{13}(i)$ and $e_{12}(i)$. The sum of the first and second products, and thus a linear combination of the weighted gradient estimates, is applied to the top function unit 10.

Similarly, error values $e_{31}(i)$ and $e_{32}(i)$ are formed in the bottom half of the block diagram shown in FIG. 5. The error values $e_{31}(i)$ are the result of the subtraction $x3_{int}(i)-x1(i)$. The error values $e_{32}(i)$ are the result of the subtraction $x3_{int}(i)-x2(i)$. A third product $0.3*e_{31}(i)*x1_H(i)$ and a fourth product $0.7*e_{32}(i)*x2_H(i)$ are added together and the resultant sum is applied to the bottom function unit 10.

With the aid of the speech processing device shown in FIG. 3, which comprises a control device shown in FIG. 4 or 5, a sum signal X(i) is generated which is improved compared with a sum signal obtained from a speech processing device that comprises two microphones shown in FIG. 1. The signal-to-noise ratio and thus the speech quality of the sum signal X(i) of the speech processing device shown in FIG. 3 is further increased compared with the sum signal X(i) generated by the speech processing device shown in FIG. 1. The control device shown in FIG. 5, compared with the control device shown in FIG. 4, shows enhanced stability when used in a speech processing device shown in FIG. 3.

Both in FIG. 4 and in FIG. 5 a representation of the arrangement (see function blocks 7 and 8, buffer 9 and switch 11 in FIG. 2) has been omitted for clarity, which arrangement provides a dependence of the speech processing on estimates SNR(i) for one of the microphone signals x1(i), x2(i) or x3(i). Also for clarity, the normalization of products of error values and of the output values of digital filter 6, which performs a Hilbert transform to the power of an associated microphone signal (see $1/P_{x2}(i)$ in FIG. 2), is not shown. The extension of the control devices 26 shown in FIGS. 4 and 5 by these two technical features is evident from their realisation in the control device 3 shown in FIG. 2.

Figure 6:
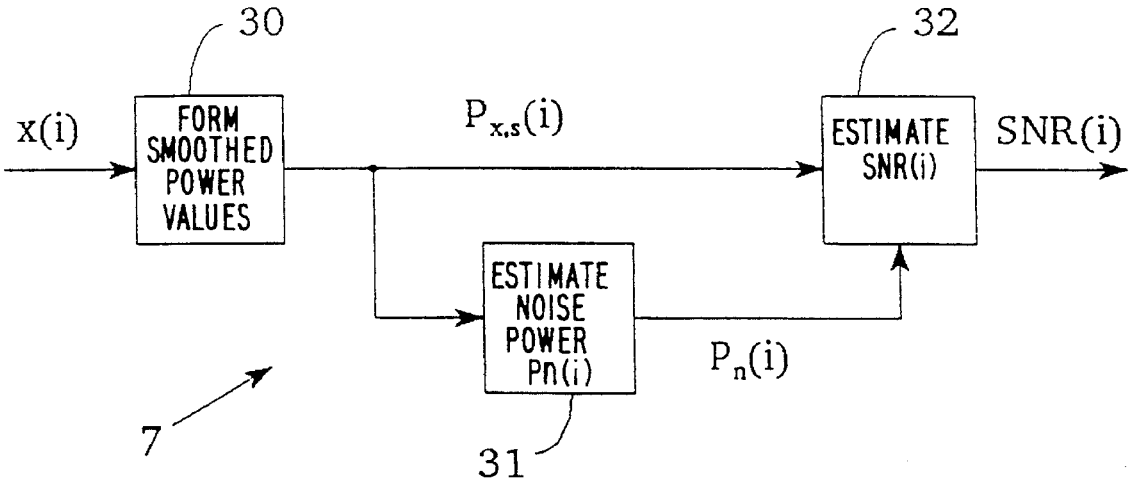

The manner in which the function block 7 in FIG. 2 derives from a sampled switch signal x(i) which is formed by noise and speech components the associated estimates SNR(i) of this signal-to-noise ratio, i.e. of the ratio of the power of the speech component to the power of the noise component is explained with reference to FIGS. 6 and 7. The sample values x(i) correspond in FIG. 2 to the sample values x2(i). In FIG. 6 the function block 7 is shown in a block circuit diagram. A function block 30 is used for forming power values $P_x(i)$ of the sample values x(i) by squaring the sample values. Furthermore, the function block 30 performs a smoothing operation of these power values $P_x(i)$. The smoothed power values $P_{x,s}(i)$ thus obtained are applied both to the function block 31 and to the function block 32. The function block 31 continuously determines estimates $P_n(i)$ for estimating the power of the noise component of the sample values x(i) i.e. the power of the noise components of the sample values x(i) is determined. The function block 32 continuously forms estimates SNR(i) of the signal-to-noise ratio of the sample values x(i) from the smoothed power values $P_{x,s}(i)$ and the estimates $P_n(i)$.

Figure 7:
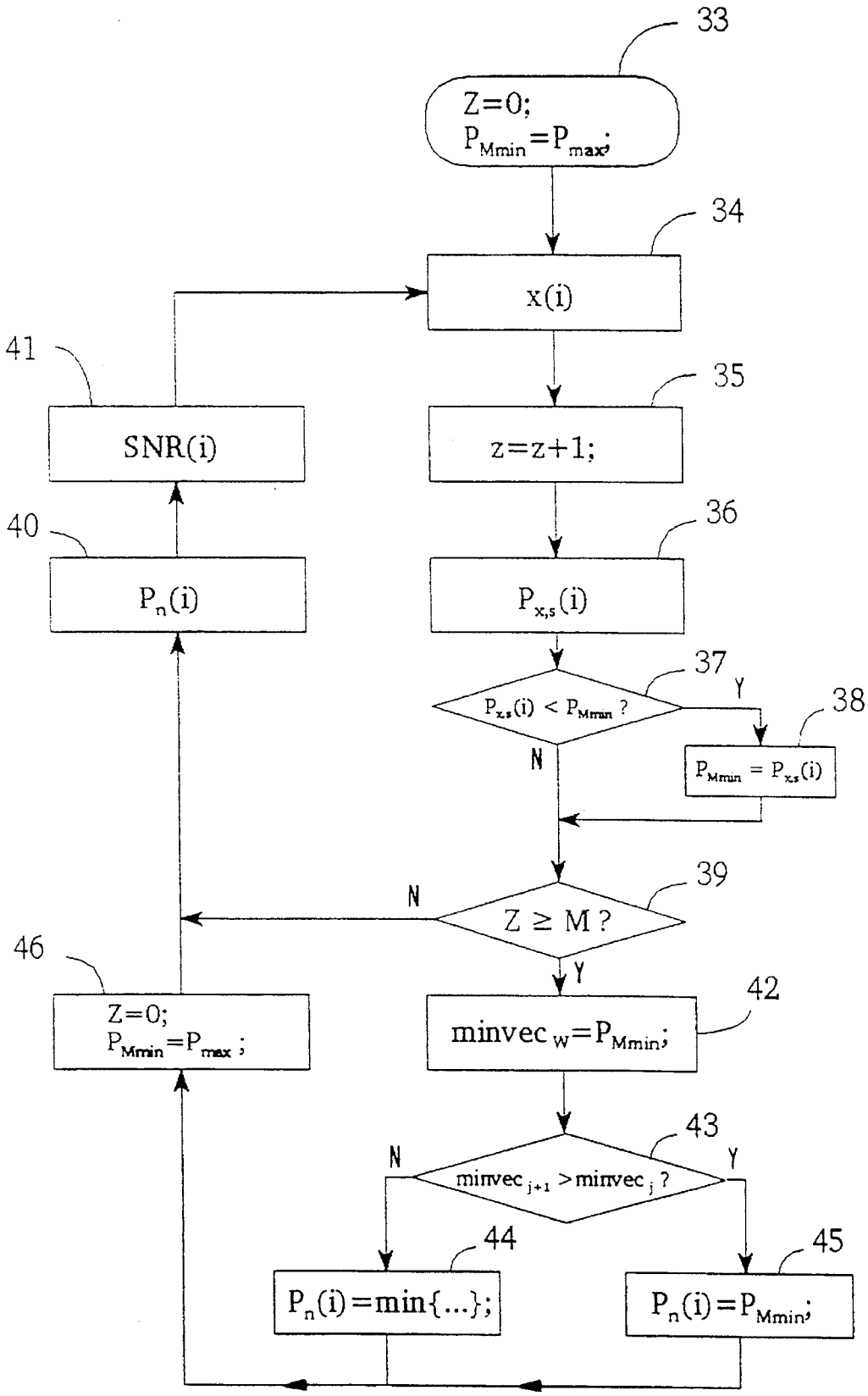

FIG. 7 shows a flow chart which gives a further explanation of the operation of the function block 7. With the aid of the flow chart it becomes evident how a computer program forms estimates SNR(i) of the signal-to-noise ratio based upon the sample values x(i) of the speech signal x. In an initialization block 33 at the beginning of the program shown in FIG. 7 a counter variable Z is set to 0 and a variable $P_{Mmin}$ iS set to a value $P_{max}$, $P_{max}$ is selected to be so large that the smoothed power values $P_{x,s}(i)$ are always smaller than $P_{max}$, $P_{max}$ may be set, for example, to the maximum numerical value of a computer used for running the program. In a block 34 a new sample value x(1) is written. In block 35 a counter variable Z is incremented by unity, after which a new smoothed power value $P_{x,s}(i)$ is formed in block 36. As a result, first a short-term power value $P_x(i)$ is formed as a result of $$P_x(i)=P_x(i-1)+x^2(i)-x^2(i-N) \quad (1)$$

after which a new smoothed power value is formed according to $$P_{x,s}(i)=\alpha*P_{x,s}(i-1)+(1-\alpha)*P_x(i) \quad (2)$$

A short-term power value $P_x(i)$ of a group of N successive sample values x(i) is then determined with formula (1). N is here, for example, equal to 128. The value of $\alpha$ of equation (2) lies between 0.95 and 0.98. The smoothed power values $P_{x,s}(i)$ can also be determined with only equation (2), in which case the value of $\alpha$ is then certainly to be increased to 0.99 and $P_x(i)$ is to be replaced by $x^2(i)$.

A branch 37 then inquires whether the smoothed power value $P_{x,s}(i)$ just determined is smaller than $P_{Mmin}$. If this inquiry is responded to positively i.e. $P_{x,s}(i)$ is smaller than $P_{Mmin}$, $P_{Mmin}$ is set to the value $P_{x,s}(i)$ by block 38. If the inquiry of branch 37 is responded to negatively, block 38 is skipped. As a result thereof, $P_{Mmin}$ has the minimum of M smoothed power values $P_{x,s}$ after M program cycles. Then, in the branch 39 there is the inquiry whether the counter variable Z has a value greater than or equal to a value M. In this manner there is established whether M smoothed power values have already been processed.

If the inquiry of branch 39 is responded to negatively, i.e. M smoothed power values have not yet been processed, the program is continued with block 40. In that block a preliminary estimate $P_n(i)$ of the noise power of the speech signal x is determined by $$P_n(i)=\min\{P_{x,s}(i),P_n(i)\} \tag{3}$$

This operation ensures that the preliminary estimate $P_n(i)$ cannot be greater than the current smoothed power value $P_{x,s}(i)$. Subsequently, with block 41 a current estimate SNR(i) of the signal-to-noise ratio of the speech signal x(i) is determined according to $$SNR(i)=[P_{x,s}(i)-\min\{c*P_n(i),P_{x,s}(i)\}]/[c*P_n(i)] \tag{4}$$

Normally, the product $c*P_n(i)$ is used for estimating the current power of the noise component and the difference $P_{x,s}(i)-c*P_n(i)$ is used for estimating the current power of the speech component of the speech signal x(i). The current power of the speech signal is estimated by the smoothed power value $P_{x,s}(i)$. The weighting with a scaling factor c prevents that $P_n(i)$ is too small a value for an estimate of the noise power. The scaling factor c typically lies in the range from 1.3 to 2. The minimization in block 41 or equation (4) ensures that the non-logarithmic signal-to-noise ratio SNR(i) is also positive if, exceptionally, $c*P_n(i)$ is greater than $P_{x,s}(i)$. In that case the power of the noise component of the speech signal is set to the estimated power of the speech component $P_{x,s}(i)$. The power of the speech component estimated by $P_{x,s}(i)-P_{x,s}(i)$ is then equal to zero as is the non-logarithmic signal-to-noise ratio. After the estimate SNR(i) has been computed the program is continued with block 34 writing a new speech signal sample value x(i).

If the inquiry of branch 39 is responded to positively i.e. M smoothed sample values $P_{x,s}(i)$ have been processed, the components of a vector minvec having dimension W are updated in accordance with $$\begin{aligned} minvec_1 &= minvec_2; \\ minvec_2 &= minvec_3; \\ &\vdots \\ minvec_{W-1} &= minvec_W; \\ minvec_w &= P_{Mmin}; \end{aligned} \tag{5}$$

Then there is an inquiry in branch 43 whether the components $minvec_l$ to $minvec_w$ rise with an ascending vector index i.e. whether the following holds:

$$minvec_{j+1}>minvec_j \text{ for } 1\leqq j\leqq W-1 \tag{6}$$

If the inquiry of branch 43 is responded to negatively i.e. the most recently determined W minima in the components of the vector minvec do not show a monotonously ascending line, block 44 determines in accordance with $$P_n(i)=\min\{minvec_W, minvec_{W-1}, \ldots, minvec_1\} \tag{7}$$

the preliminary estimate $P_n(i)$ of the noise power from the minima of the components of the vector minvec i.e. from the minimum of the most recent L=W*M successive smoothed power values $P_{x,s}(i)$. If the inquiry is positively responded to in branch 43 i.e. if the most recently determined W minima in the components of the vector minvec show a monotonously ascending line, block 45 sets $P_n(i)$ to $P_{Mmin}$, so that an adjustment of the estimate for the noise component is made rapidly, because $P_n(i)$ is determined at the minimum of the most recent (M<L) values. After that, the counter variable Z is reset to 0 in block 46 and $P_{Mmin}$ again assumes the value of $P_{max}$.

The program described combines M successive smoothed $P_{x,s}(i)$ sample values x(i) of the speech signal x to a sub-group. Within such a sub-group the minimum of the smoothed power values $P_{x,s}(i)$ is determined by the operations performed by branch 37 and block 38. The most recently determined W minima are stored in the components of the vector minvec. If the last W minima do not show a monotonously ascending line (compare branch 43), according to block 44 a preliminary estimate $P_n(i)$ of the power of the noise component is determined from the minimum of the minima of the last W sub-groups i.e. from the minimum of one group. To form a group having L =W*M successive smoothed power values $P_{x,s}(i)$, W successive sub-groups are combined. The groups having each L values uninterruptedly follow each other and overlap with L–M smoothed powers $P_{x,s}(i)$.

For the case where the minima of W successive sub-groups show a monotonously ascending line (see branch 43), block 45 utilizes the minimum of the last sub-group having M smoothed power values $P_{x,s}(i)$ for estimating the current estimate $P_n(i)$ of the power of the noise component. The time interval in which the monotonously ascending smoothed power values $P_{x,s}(i)$ also cause a change of the estimates SNR(i) is then shortened.

Figure 8:
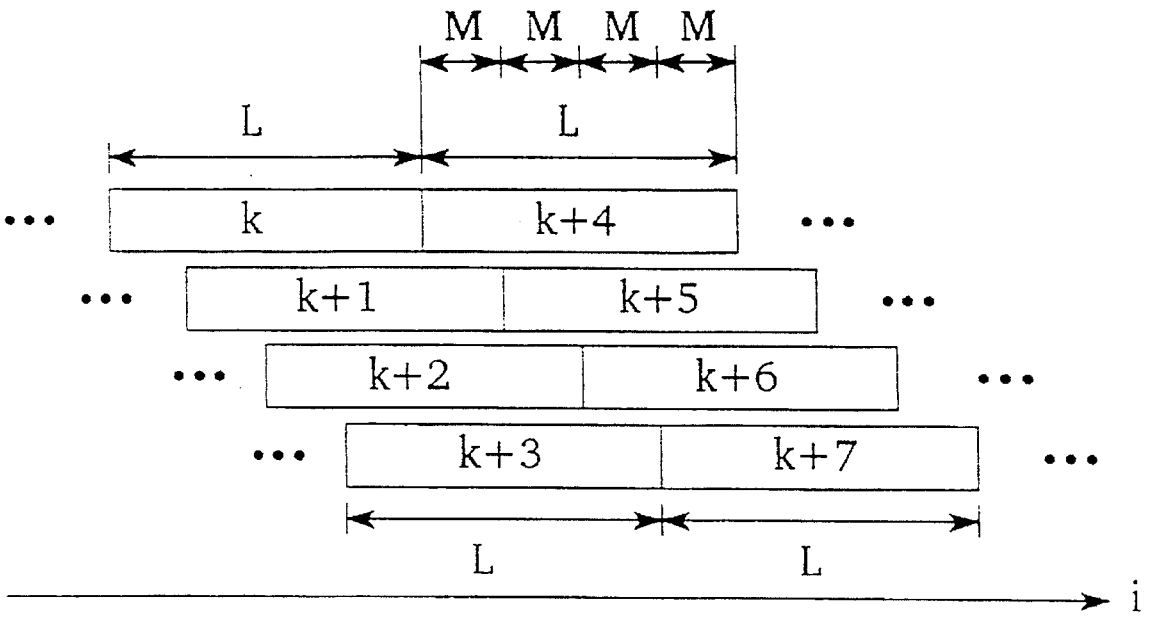
FIG. 8 shows a subdivision of smoothed power values of a speech signal into groups and sub-groups.

FIG. 8 clarifies how the smoothed power values $P_{x,s}$ are combined to form groups and sub-groups. M smoothed power values $P_{x,s}(i)$, which are available at the sampling instants i, are combined to a sub-group. The sub-groups are adjacent to each other. For each sub-group the minimum of the smoothed power values $P_{x,s}(i)$ is determined. W sub-group minima are stored in the vector minvec. As a rule, i.e. with W sub-group minima that do not show a monotonously ascending line, W sub-groups are combined to form a group of L=W*M smoothed power values $P_{x,s}(i)$. Each time after M smoothed power values $P_{x,s}(i)$ the value $P_n(i)$ used for estimating the noise power is computed from the minimum of the last W sub-group minima or the last L smoothed power values $P_{x,s}(i)$, respectively. FIG. 8 shows eight groups having each L sample values x(i), which groups contain each W=4 sub-groups having M smoothed power values $P_{x,s}(i)$. The eight groups partly overlap. For example, two successive groups contain each L–M identical smoothed power values $P_{x,s}(i)$. In this manner a good compromise between the necessary computation circuitry and the delay time is achieved, so that an updating of an estimate $P_n(i)$ of the noise power for updating an estimate SNR(i) of the signal-to-noise ratio is effected. This can also be realised with adjacent i.e. non-overlapping groups. But then, with reduced computation circuitry, the time interval between two estimates SNR(i) is lengthened, so that the reaction time to a changing SNR of the speech signal x(i) is lengthened.

The speech processing device described therefore has an estimating device which is suitable for continuously forming estimates SNR(i) of the signal-to-noise ratio of noise-affected speech signals x(i). Of special interest is that no speech pauses are necessary for estimating the noise power. The estimating device described utilizes the special time characteristic of smoothed power values of the speech signal x(i), which is featured by peaks and intervening regions with smaller smoothed power values $P_{x,s}(i)$, of which the extension over time depends on the speech source i.e. the particular speaker. The regions in between the peaks are then used for estimating the power of the noise component. The groups of L smoothed power values $P_{x,s}(i)$ are to be adjacent i.e. they are either to be contiguous or overlap. Furthermore, there should be ensured that at least one value of a region lying between two peaks can be detected with rather small smoothed power values $P_{x,s}(i)$ of each group i.e. each group is to have enough smoothed power values $P_{x,s}(i)$, so that all the values belonging to a specific peak can be detected. As the peaks which are stretched out most over time can be estimated by the speech signal phonemes lying apart the most, i.e. the vocals, the number L which describes the group size can be derived therefrom. For a sampling rate of the speech signal of 8 kHz, an appropriate value of L lies in the range from 3000 to 8000. A suitable value for W is 4. With such a dimensioning there is a good compromise between computation circuitry and reaction time of the function block 7.

Figure 9:
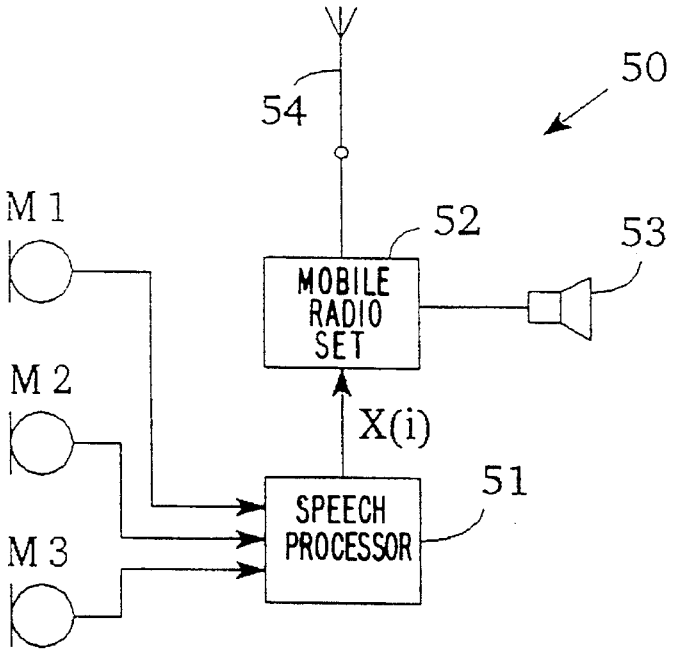
FIG. 9 shows a mobile radio set comprising a speech processing device shown in FIGS. 1 to 8.

FIG. 9 shows the use of a speech processing device of FIG. 3 in a mobile radio set 50. The speech processing means 20 to 26 are combined into one function block 51, which forms the sum signal values X(i) from the microphone/speech signals produced by the microphones M1, M2 and M3. A function block 52 processing the sum signal values X(i) combines all the further means of the mobile radio set (52) for receiving, processing and transmitting signals, which are used for communication with a base station (not shown), the transmission and reception of signals being effected via an antenna 54 coupled to the function block 52. Furthermore is provided a loudspeaker 53 coupled to the function block 52. The acoustic communication of a user (speaker, listener) with the mobile radio set 50 takes place via the microphones M1 to M3 and the loudspeaker 53 which form part of a hands-free facility integrated in the mobile radio set 50. The use of such a mobile radio set 50 is especially advantageous in private cars, because it is there that interference, especially by engine and driving noise (noise), occurs with hands-free calls via the mobile radio set.

I claim:

1. A mobile radio set which comprises a speech processing device for processing speech signals having noise components and speech components, said device including a control unit for continuously forming estimates of the signal-to-noise ratio (SNR(i)) of the speech signals; said control unit comprising:

means for deriving digital samples (x(i)) of the speech signals;

means for determining and smoothing power values of the digital samples;

means for determining for each successive group of L samples the minimum of the L smoothed power values thereof, the groups uninterruptedly succeeding each other and L being a number which is at least sufficient so that all of the smoothed power values of a group which are associated with a random phoneme of the speech signal can be combined; and means for estimating a present signal-to-noise ratio on the basis of the difference between a present smoothed power value and the most recently determined minimum smoothed power value.

2. A mobile radio set as claimed in claim 1, wherein said control unit further comprises means for dividing each group of L smoothed power values into W subgroups of M=L/W smoothed power values, W being an integer≧2; determination of the minimum power value of a group being by determining the minimum of the minima of the W successive sub-groups thereof.

3. A mobile radio set as claimed in claim 2, wherein said means for estimating a present signal-to-noise ratio utilizes the most recently determined minimum smoothed power value of a sub-group instead of the most recently determined minimum smoothed power value of a group when there is a predetermined number of monotonously rising minima of the successive sub-groups of said group.

4. A mobile radio set as claimed in claim 2, wherein said means for estimating a present signal-to-noise ratio utilizes a present smoothed power value instead of a most recently determined group or sub-group minimum smoothed power value when the present smoothed power value is smaller than the most recently determined minimum smoothed power value.

5. A mobile radio set as claimed in claim 1, wherein said control unit controls processing of the speech signals consistent with the estimated signal-to-noise ratio of the speech signals.

6. A speech processing device for processing speech signals having noise components and speech components, said device including a control unit for continuously forming estimates of the signal-to-noise ratio (SNR(i)) of the speech signals; said control unit comprising:

means for deriving digital samples (x(i)) of the speech signals;

means for determining and smoothing power values of the digital samples;

means for determining for each successive group of L samples the minimum of the L smoothed power values thereof, the groups uninterruptedly succeeding each other and L being a number which is at least sufficient so that all of the smoothed power values of a group which are associated with a random phoneme of the speech signal can be combined; and means for estimating a present signal-to-noise ratio on the basis of the difference between a present smoothed power value and the most recently determined minimum smoothed power value.

* * * * *